US009417011B2

(12) United States Patent
Burgers et al.

(10) Patent No.: US 9,417,011 B2
(45) Date of Patent: Aug. 16, 2016

(54) HEAT EXCHANGER WITH SELF-ALIGNING FITTINGS

(71) Applicant: Dana Canada Corporation, Oakville (CA)

(72) Inventors: John G. Burgers, Oakville (CA); Meinrad K. A. Machler, Oakville (CA); Michael A. Martin, Hamilton (CA); Kenneth M. A. Abels, Oakville (CA)

(73) Assignee: Dana Canada Corporation, Oakville, Ontaria (CA)

( * ) Notice: Subject to any disclaimer, the term of this patent is extended or adjusted under 35 U.S.C. 154(b) by 304 days.

(21) Appl. No.: 14/178,594

(22) Filed: Feb. 12, 2014

(65) Prior Publication Data

US 2014/0225363 A1 Aug. 14, 2014

Related U.S. Application Data

(60) Provisional application No. 61/763,747, filed on Feb. 12, 2013.

(51) Int. Cl.

| | |
|---|---|
| ***F28D 9/00*** | (2006.01) |
| ***F28F 9/02*** | (2006.01) |
| *F28F 21/08* | (2006.01) |

(52) U.S. Cl.

CPC ..... *F28D 9/0043* (2013.01); *F28F 9/0258* (2013.01); *F28F 21/084* (2013.01); *F28F 2275/04* (2013.01)

(58) Field of Classification Search

CPC .. F28D 9/0043; F28F 21/084; F28F 2275/045
USPC ..... 285/124.4, 124.2, 184.3, 347, 374, 196, 285/201; 165/176, 177
See application file for complete search history.

(56) References Cited

U.S. PATENT DOCUMENTS

| | | | | | |
|---|---|---|---|---|---|
| 2,516,743 | A * | 7/1950 | Allin | F16L 27/113 | 235/98 R |
| 2,914,344 | A * | 11/1959 | Anthes | F16L 37/084 | 285/321 |
| 2,932,531 | A * | 4/1960 | Briechle | F16K 15/20 | 137/234.5 |
| 3,282,612 | A * | 11/1966 | Younger | F16L 39/00 | 285/124.2 |
| 3,438,653 | A | 4/1969 | Fowler | | |
| 4,054,306 | A | 10/1977 | Sadoff, Jr. et al. | | |
| 4,357,990 | A | 11/1982 | Melnyk | | |
| 5,477,919 | A * | 12/1995 | Karube | F28F 9/027 | 165/176 |
| 5,509,696 | A | 4/1996 | Smith et al. | | |
| 5,630,326 | A * | 5/1997 | Nishishita | F28F 9/0246 | 165/153 |
| 5,630,470 | A * | 5/1997 | Lockwood, Jr. | F28F 21/04 | 165/178 |
| 5,681,060 | A * | 10/1997 | Berg | F16L 37/088 | 285/305 |
| 6,196,306 | B1 * | 3/2001 | Aikawa | F28F 9/0246 | 165/153 |

(Continued)

*Primary Examiner* — David E Bochna
(74) *Attorney, Agent, or Firm* — Marshall & Melhorn, LLC

(57) ABSTRACT

A heat exchanger has inlet and outlet fittings, each having a base portion and a top portion, and having a circumferential groove provided with a resilient sealing element for sealing within a bore of a coolant manifold. Each fitting also has a base fitting with an annular sealing surface sealed to a surface of the heat exchanger. In an embodiment, the base portion has a larger diameter than the top portion, and the groove and sealing element are provided in the bottom portion, with a chamfer or sloped surface separating the base and top portions. In another embodiment, the top portion has a larger diameter than the base portion, and the groove and sealing element are provided in the top portion.

14 Claims, 18 Drawing Sheets

(56) References Cited

U.S. PATENT DOCUMENTS 6,199,915 B1 * 3/2001 Becker ..... F16L 33/16 285/239
6,676,167 B2 * 1/2004 Schroeder ..... F16L 21/08 285/124.4
6,709,023 B2 3/2004 French
6,776,225 B2 * 8/2004 Leitch ..... F28F 9/0246 165/173
7,021,668 B2 * 4/2006 Langenfeld ..... F16L 37/56 285/124.1
7,219,717 B2 * 5/2007 Hanafusa ..... F28F 9/0246 165/153
7,258,369 B2 * 8/2007 Martin ..... F16L 37/56 285/124.4
7,258,371 B1 * 8/2007 Hagen ..... F16L 21/02 285/321
7,364,207 B2 * 4/2008 McGee ..... F16L 19/0206 285/321
7,926,853 B2 * 4/2011 Katoh ..... F16L 13/122 285/124.1
7,926,854 B2 * 4/2011 Sharma ..... F28F 9/0253 165/176
8,075,021 B2 * 12/2011 Park ..... F28F 9/0234 285/124.4
8,186,719 B2 * 5/2012 Kume ..... F28F 9/0246 165/176
8,205,667 B2 * 6/2012 Yoshino ..... F16L 21/08 165/176
8,231,143 B2 7/2012 Takasaki et al.
2004/0036277 A1 * 2/2004 Inaba ..... F16L 39/00 285/124.4
2005/0023827 A1 * 2/2005 Walterscheid ..... F28F 9/0246 285/124.2
2007/0085339 A1 * 4/2007 Tsuji ..... F16L 39/00 285/133.4
2007/0241560 A1 10/2007 Malone
2009/0140515 A1 6/2009 Ichimura et al.
2009/0146415 A1 * 6/2009 Abei ..... F16L 21/02 285/30
2012/0118548 A1 5/2012 Han et al.
2012/0292002 A1 11/2012 Saumweber et al.
2013/0228307 A1 9/2013 Kanzaka et al.
2014/0300105 A1 * 10/2014 Kalbacher ..... F28D 9/0043 285/351

* cited by examiner

HEAT EXCHANGER WITH SELF-ALIGNING FITTINGS

CROSS-REFERENCE TO RELATED APPLICATION

This application claims priority to and the benefit of U.S. Provisional Patent Application No. 61/763,747 filed Feb. 12, 2013, the contents of which are incorporated herein by reference.

FIELD OF THE INVENTION

The invention relates to a heat exchanger with fittings which self-align when inserted into a rigid manifold.

BACKGROUND

Most conventional heat exchangers use fluid connecting fittings that interface with the vehicle transmission, engine, power steering etc. via tube or hose type fluid conduits. These conduits are relatively flexible, and can accommodate a certain degree of misalignment or variation in the heat exchanger fittings.

Recently, there is a trend to provide fluid connections that require the heat exchanger to interface directly with a rigid manifold. Such rigid manifolds use machining to create fitting receptacles or "sockets" to receive the heat exchanger fittings. But today's machining technology can achieve dimensional tolerances with much greater precision than brazed heat exchanger product assemblies, as the latter involve significant stack up tolerance variation. This can create a conflict in dimensional control needed to achieve a manufacturable heat exchanger assembly, and a reliable seal.

There is a need to provide a more manufacturable heat exchanger with fittings which self-align during insertion into a rigid manifold.

SUMMARY

According to an embodiment, there is provided a heat exchanger, comprising: an inlet opening provided with an inlet fitting; an outlet opening provided with an outlet fitting, wherein the inlet and outlet fittings are hollow and have open ends, and wherein the fittings face in the same direction and are spaced apart from one another; wherein each of the fittings have a cylindrical base portion and a cylindrical top portion, wherein each of the fittings is provided with a circumferential groove extending about its entire circumference, and a resilient sealing element is received in the groove; wherein the base portion of each of the fittings has a flat, annular sealing surface which is sealed to a surface of the heat exchanger in an area surrounding the inlet opening or the outlet opening.

According to an embodiment, the base portion of each of the fittings has a radially outwardly extending planar base flange, and the flat, annular sealing surface comprises a bottom surface of the planar base flange, wherein said surface of the heat exchanger is flat.

According to an embodiment, said surface of the heat exchanger comprises an outer surface of a plate comprised of an aluminum brazing sheet, wherein the inlet and outlet fittings are formed of aluminum or an aluminum alloy, and wherein the inlet and outlet fittings are both sealed to the outer surface of said plate by brazing.

According to an embodiment, the cylindrical base portion has a larger diameter than the cylindrical top portion, and the circumferential groove and the resilient sealing element may be provided in the top portion or in the base portion.

According to an embodiment, the circumferential groove and the resilient sealing element are provided in the base portion, and each of the fittings further comprises a sloped surface which forms a transition between the base portion and the top portion of the fitting, such that the base portion extends to a bottom edge of the sloped surface. The circumferential groove of the base portion of each said fitting may be located approximately midway between the ends, and each of the fittings may have a top end with a radially inwardly extending sloped surface.

According to an embodiment, the top portion has a larger diameter than the cylindrical base portion, and wherein the circumferential groove and the resilient sealing element are provided in the top portion.

According to an embodiment, each of the fittings has a top end with a radially inwardly extending sloped surface located between the resilient member and the top end, and wherein the top end of the fitting has a smaller diameter than an outside diameter of resilient member.

According to an embodiment, the groove has a rectangular cross-section and the sealing member comprises a sealing gland having a rectangular profile on its inner radial face, and having a spherical profile on its outer radial face.

According to an embodiment, the top portion of the fitting has a truncated spherical cross-section having a radius which is less than a radius of the spherical profile on the outer radial face of the sealing gland.

According to an embodiment, there is provided, in combination, a heat exchanger and a rigid manifold, wherein the heat exchanger has an inlet opening provided with an inlet fitting and an outlet opening provided with an outlet fitting, wherein the inlet and outlet fittings face in the same direction and are spaced apart from one another; wherein the rigid manifold comprises an inlet socket in which the inlet fitting is received, and an outlet socket in which the outlet fitting is received, the inlet and outlet sockets being spaced apart from one another; each of the fittings having a cylindrical base portion proximate to the inlet or outlet opening with which it is associated, and a cylindrical top portion distal therefrom, the base portion having a larger diameter than the top portion, wherein the base portion is provided with a circumferential groove extending about its entire circumference, and a resilient sealing element is received in the groove; each of the sockets having a cylindrical base portion proximate to an open mouth of the socket, and a cylindrical top portion distal therefrom, wherein the top portion of the socket receives the top portion of one of the fittings, and the base portion of the socket receives the base portion of the same fitting, and wherein an inner cylindrical surface of the base portion of the socket provides a sealing surface against which the resilient sealing member is received with a fluid-tight seal.

According to an embodiment, the sealing surface of each of the sockets has an inner diameter which is equal to or greater than a maximum outside diameter of the top portion of the fitting with which it is associated, plus a maximum diametrical position tolerance of a top end of the fitting.

According to an embodiment, each of the fittings further comprises a sloped surface which forms a transition between the base portion and the top portion of the fitting; wherein each of the sockets further comprises a sloped surface which forms a transition between the base portion and the top portion of the socket; and wherein the sloped surface of each fitting engages the sloped surface of the socket with which it is associated with the fitting completely inserted in the socket.

According to an embodiment, each of the fittings has a top end distal from the base, and wherein a distance from the top end of the fitting to the resilient member is greater than a distance from the open mouth of the socket to the bottom end of the top portion of the socket.

According to an embodiment, each of the fittings has a top end with a radially inwardly extending sloped surface, and wherein a distance between a bottom end of the sloped surface and the resilient member is greater than a distance from the open mouth of the socket to the bottom end of the top portion of the socket.

According to an embodiment, there is provided, in combination, a heat exchanger and a rigid manifold, wherein the heat exchanger has an inlet opening provided with an inlet fitting and an outlet opening provided with an outlet fitting, wherein the inlet and outlet fittings face in the same direction and are spaced apart from one another; wherein the rigid manifold comprises an inlet socket in which the inlet fitting is received, and an outlet socket in which the outlet fitting is received; each of the fittings having a cylindrical base portion proximate to the inlet or outlet opening with which it is associated, and a cylindrical top portion distal therefrom, the top portion having a larger diameter than the base portion, wherein the top portion is provided with a circumferential groove extending about its entire circumference, and a resilient sealing element is received in the groove; each of the sockets having an outwardly sloped base portion proximate to an open mouth of the socket, and a cylindrical top portion distal therefrom, wherein the top portion of the socket receives the top portion of one of the fittings, and the base portion of the socket receives the base portion of the same fitting, and wherein an inner cylindrical surface of the base portion of the socket provides a sealing surface against which the resilient sealing member is received with a fluid-tight seal; and wherein each of the fittings has a top end with a radially inwardly extending sloped surface located between the resilient member and the top end, and wherein the top end of the fitting has a smaller diameter than an outside diameter of resilient member.

According to an embodiment, the groove has a rectangular cross-section and the sealing member comprises a sealing gland having a rectangular profile on its inner radial face, and having a spherical profile on its outer radial face.

According to an embodiment, the top portion of the fitting has a truncated spherical cross-section having a radius which is less than a radius of the spherical profile on the outer radial face of the sealing gland.

BRIEF DESCRIPTION OF THE DRAWINGS

The invention will now be described, by way of example only, with reference to the accompanying drawings in which.

DETAILED DESCRIPTION

Figure 1:
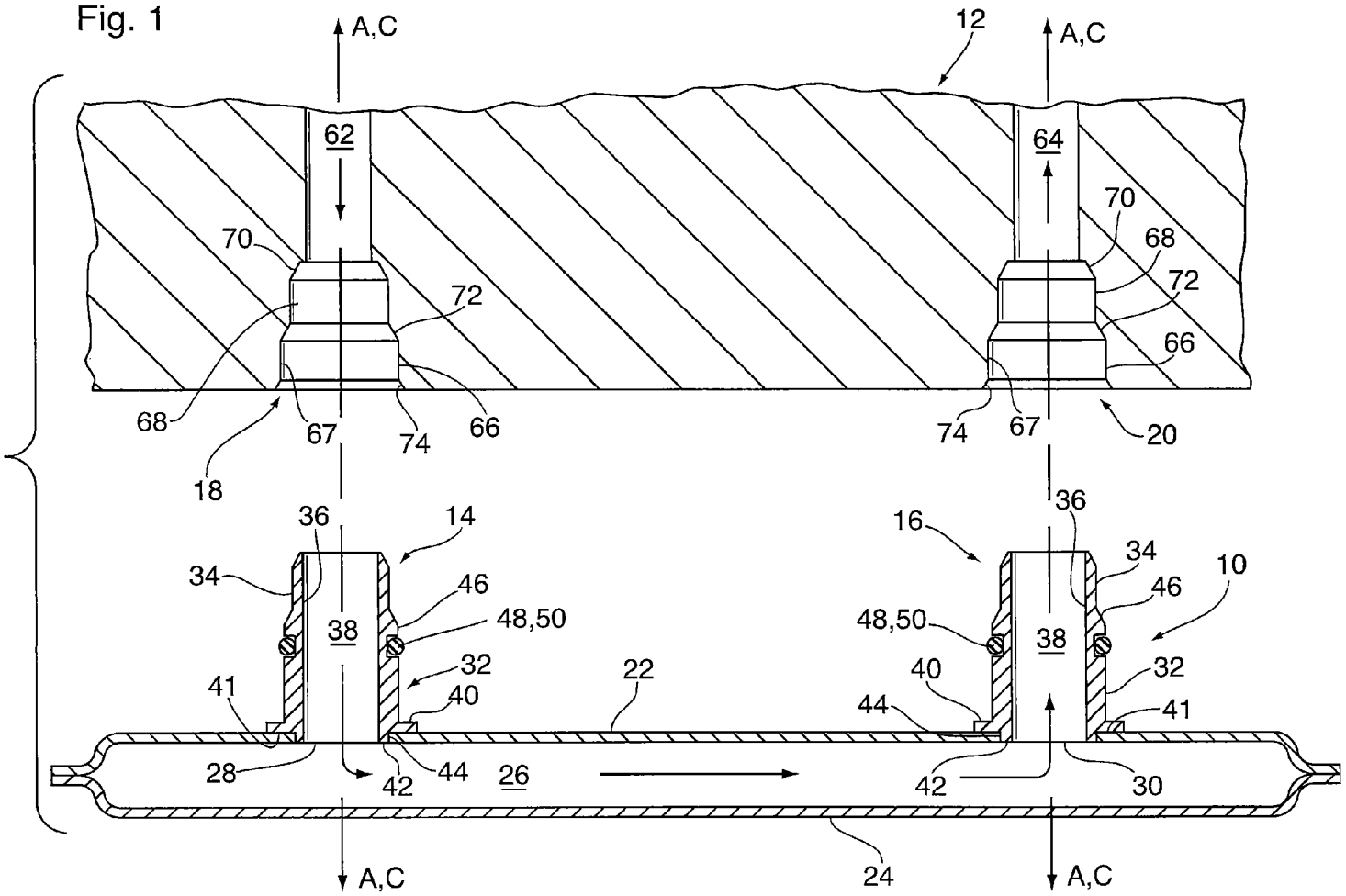
FIG. 1 is a cross-sectional view of a heat exchanger and rigid manifold according to a first embodiment of the invention.
Figure 2:
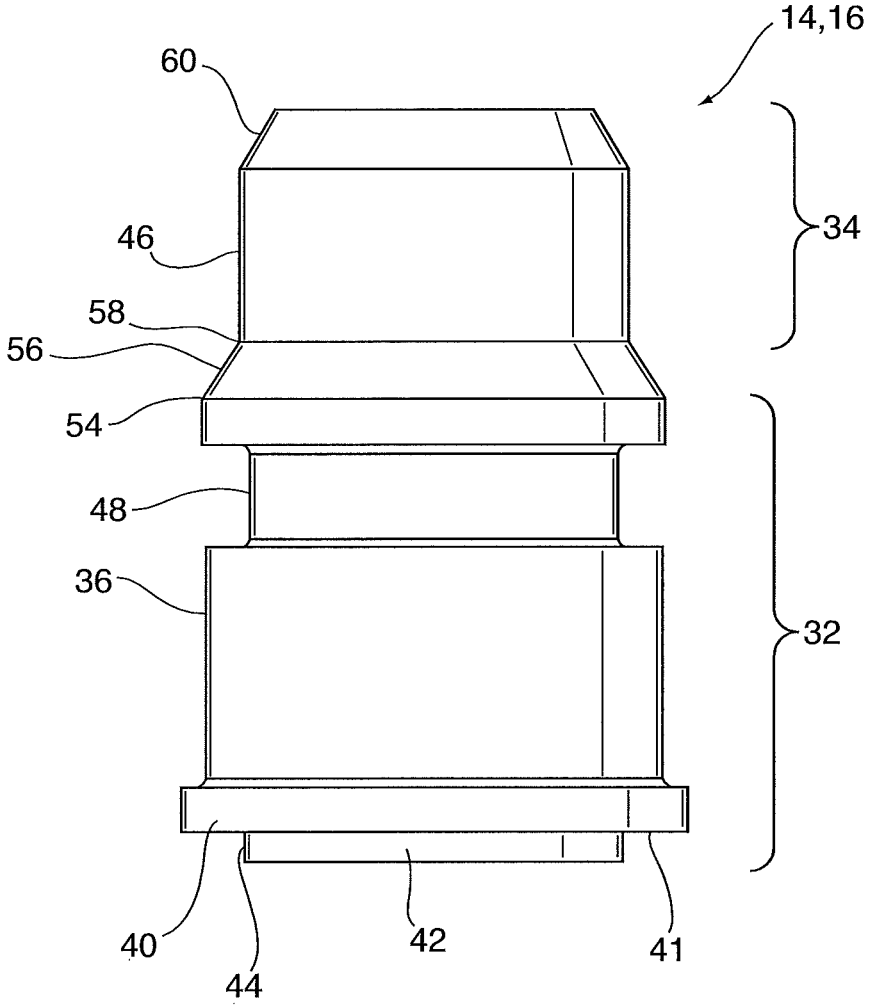
FIG. 2 is a side elevation view of a fitting of the heat exchanger of FIG. 1.
Figure 3:
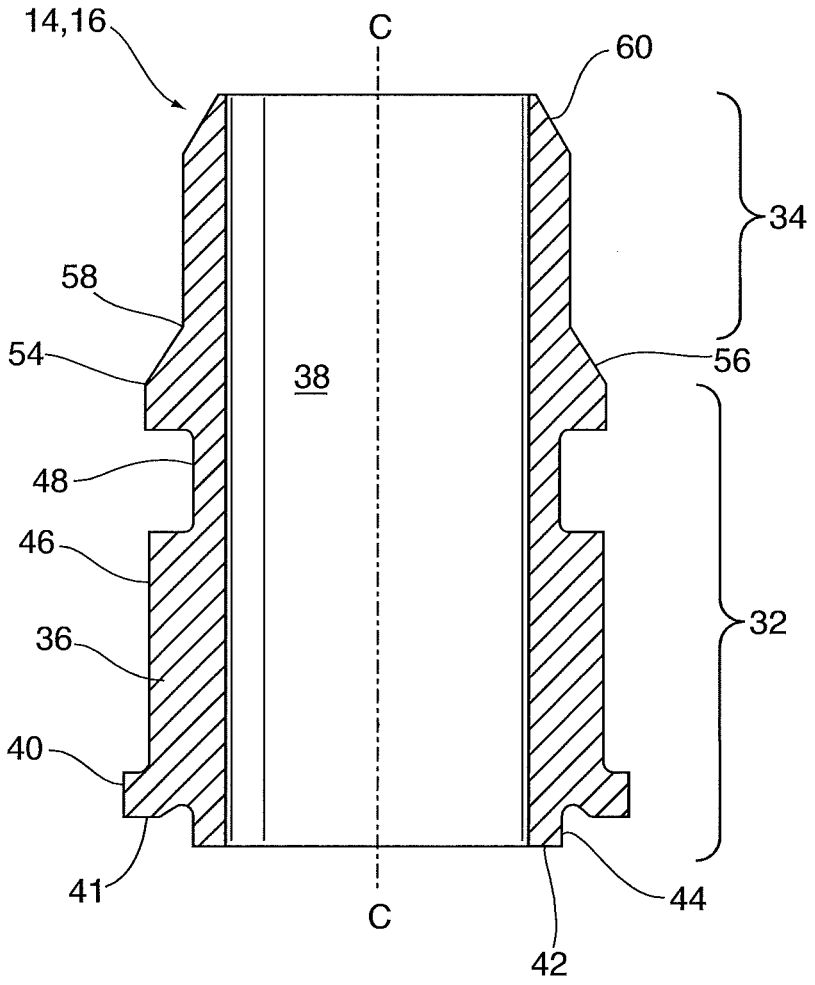
FIG. 3 is an cross sectional view of the fitting of FIG. 2 along a central longitudinal axis of the fitting.
Figure 4:
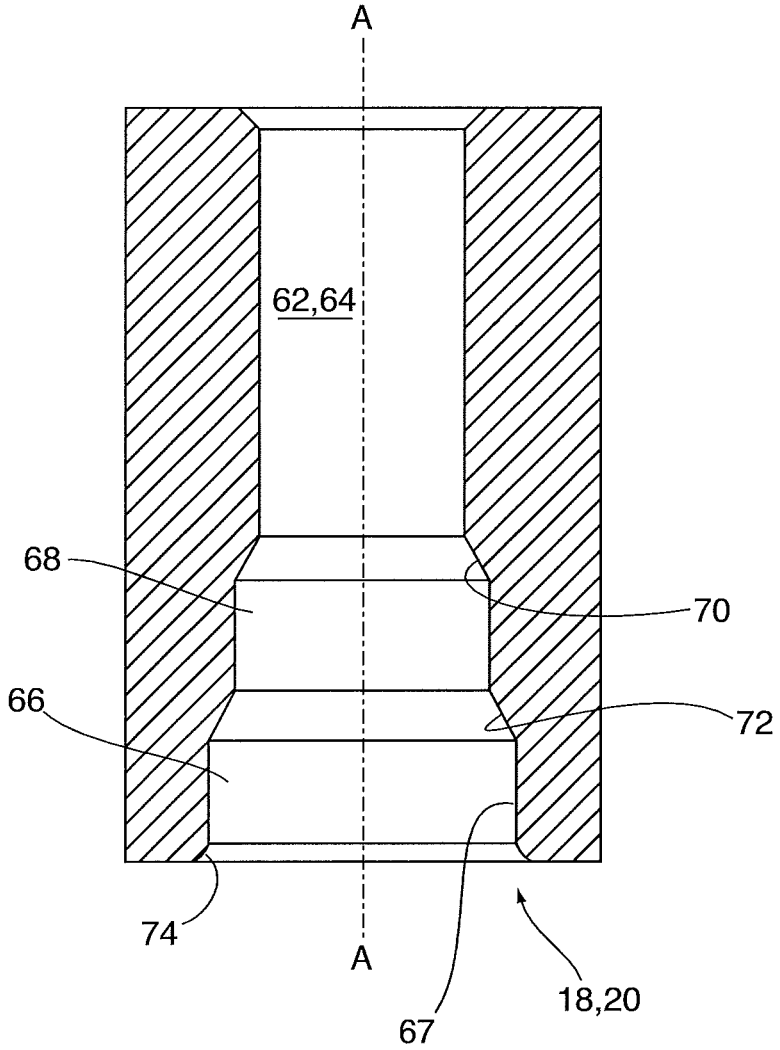
FIG. 4 is an enlarged cross-sectional view showing a socket of the rigid manifold in isolation.

A heat exchanger 10 according to a first embodiment of the invention is described below with reference to FIGS. 1 to 7.

Heat exchanger 10 is shown alongside a rigid manifold 12. The heat exchanger 10 has a pair of fittings, namely an inlet fitting 14 and an outlet fitting 16, which are to be inserted into sockets 18 and 20 of manifold 12.

Heat exchanger 10 is shown as comprising a pair of heat exchanger plates, namely a top plate 22 and a bottom plate 24. The plates 22, 24 are sealed together at their peripheral edges, for example by brazing, and enclose a fluid flow passage 26 for flow of a fluid such as a liquid engine coolant from the inlet fitting 14 to the outlet fitting 16, in the direction of the arrows shown in FIG. 1. Although flow passage 26 is described herein as a coolant flow passage for a liquid engine coolant, this is not necessarily the case. The heat exchanger plates 22, 24 and fittings 14, 16 may be comprised of aluminum or aluminum alloys, and may be joined together by brazing. The manifold 12 may also be comprised of aluminum or an aluminum alloy.

Although the structure of heat exchanger 10 is shown as comprising a single pair of plates 22, 24, it will be appreciated that the structure of heat exchanger 10, aside from the structure and location of fittings 14, 16, is relatively unimportant to the present invention, and is therefore variable. For example, heat exchanger 10 may comprise a stack of tubes or plates which are either self-enclosed or enclosed within a housing, and which do not necessarily have the appearance of plates 22, 24 of FIG. 1. Also, where the heat exchanger 10 includes multiple flow passages 26, they may alternate with flow passages for one or more other fluids. Furthermore, where the fluid flowing through flow passage 26 is a coolant, the top and/or bottom plate 22, 24 of heat exchanger may be in direct contact with a fluid and/or a solid object which requires cooling.

A pair of openings 28, 30 is formed in the top plate 22 of heat exchanger 10. Opening 28 is an inlet opening which receives the inlet fitting 14 and opening 30 is an outlet opening which receives the outlet fitting 16. The fittings 14, 16 are sealingly connected to top plate 22, for example by brazing. In this embodiment, the openings 28, 30 are circular, although it will be appreciated that the shape of the openings depends on the shape of the fittings.

The fittings 14 and 16 are shown as being identical. Therefore, only the inlet fitting 14 will be described in detail below and the elements of fittings 14, 16 are identified with the same reference numerals. Except where otherwise indicated, the following description of inlet fitting 14 also applies to outlet fitting 16.

Fitting 14 has a base portion 32 through which fitting 14 is attached to the top plate 22, and a top portion 34 at the other end of fitting 14. The base portion 32 has a larger diameter than the top portion 34. An alignment axis A extends through fitting 14 and socket 18 and defines an axial direction. The central longitudinal axis C of the fitting 14 is also shown in the drawings. The alignment axis A and the central longitudinal axis C of the fitting 14 and socket 18 are co-linear when the fitting 14 and socket are in perfect alignment with one another, as shown in FIG. 1.

The fitting 14 has a sidewall 36 which extends axially throughout the height of fitting 14, and which defines a hollow interior 38 of fitting 14. The sidewall 36 and interior 38 are shown as being generally cylindrical, and the ends of fitting 14 are open to permit fluid flow through hollow interior 38, into or out of the heat exchanger flow passage 26.

The base portion 32 of fitting 14 has a flat, annular sealing surface 41 which sits on top of top plate 22 and which is sealed to the outer surface of top plate 22 in an area surrounding the inlet opening 28, for example by brazing. In the embodiment shown in the drawings, the base portion 32 of fitting 14 has a planar base flange 40 extending radially outwardly from the base portion 32, with the annular sealing surface 41 comprising the bottom surface of the flange 40. However, it will be appreciated that the outwardly extending flange 40 may not be necessary in all embodiments, depending at least partly on the outer diameter of the base portion 32. The base flange 40 may also help to maintain the vertical orientation of fitting 14 during brazing, i.e. such that the center line of the fitting remains substantially parallel to axis A.

Located radially inwardly of sealing surface 41 is an annular ridge 42, separated from the sealing surface 41 by an axially extending shoulder 44. The shoulder 44 is provided at the inner peripheral edge of the annular sealing surface 41 and has an outer diameter which is slightly less than the diameter of the opening 28, and therefore sits inside the opening 28 with the shoulder 44 facing an edge of the opening 28, and may be sealed to the edge of opening 28 by brazing.

The base portion 32 of fitting 14 extends from the base flange 40 to a point 54 on the outer surface 46 of sidewall 36 which is the bottom edge of a sloped surface 56 (also referred to herein as "side chamfer 56") of fitting 14. The side chamfer 56 forms a transition between the larger diameter base portion 32 and the smaller diameter top portion 34 of fitting 14.

Within the base portion 32, the outer surface 46 of sidewall 36 is provided with a groove 48. In the illustrated embodiment, the groove 48 is located approximately midway between the top and bottom ends of fitting 14, and is closer to point 54 than to the base flange 40. The groove 48 extends around the entire circumference of sidewall 36 and extends radially inwardly from the outer surface 46. The groove 48 has a height (measured axially) and a depth (measured radially) sufficient to accommodate a resilient sealing member such as O-ring 50. With the exception of the base flange 40 and groove 48, the base portion 32 has a substantially constant diameter.

The top portion 34 extends from the top end of fitting 14 to a point 58 on the outer surface 46 of sidewall 36 which is the top edge of side chamfer 56. The top portion 34 has a substantially constant diameter with the exception of an inwardly extending top chamfer 60 at the nose to ease insertion of the fitting 14 into socket 18.

The sockets 18, 20 of the rigid manifold 12 may be formed by machining. For convenience, socket 18 is referred to herein as the inlet socket because it receives the inlet fitting 14 and socket 20 is referred to as the outlet socket because it receives the outlet fitting 16. The sockets 18, 20 are in flow communication with a circulation system for a fluid, such as a liquid coolant, through respective manifold flow passages 62, 64.

The sockets 18 and 20 are shown as being identical. Therefore, only the inlet socket 18 will be described in detail below and the elements of sockets 18, are identified with the same reference numerals. Except where otherwise indicated, the following description of inlet socket 14 also applies to outlet socket 20.

The socket 18 has a base portion 66 defining an open mouth of socket 18. The base portion 66 has a cylindrical sealing surface 67 with a substantially constant diameter which is greater than the diameter of the base portion 32 of fitting 14, such that a fluid-tight seal is formed with the base portion 32 of fitting 14. A bottom chamfer 74 is provided at the bottom of base portion 66, extending from the bottom edge of sealing surface 67 of base portion 66 to the open mouth of socket 18, and providing the mouth with a diameter slightly greater than that of the remainder of the base portion 66.

The socket 18 also has a top portion 68 with a diameter smaller than the diameter of the base portion 66, through which the socket 18 is connected to the manifold flow passage 62. The top of socket 18 may be provided with a top chamfer 70 which forms a transition between socket 18 and manifold flow passage 62. With the exception of top chamfer 70, the diameter of the top portion 68 is substantially constant and is greater than the diameter of the top portion 34 of fitting 14, to enable the top portion 34 of fitting 14 to be received inside the top portion 68 of socket 18.

A side chamfer 72 forms a transition between the larger diameter base portion 66 and the smaller diameter top portion 68 of socket 18.

As mentioned above, the brazed construction of heat exchanger 10 involves significant stack-up tolerance variation. The stack-up tolerance variation is the sum of a number of individual variations in the manufacture, assembly and brazing of the heat exchanger components. For example, there are small variations in the size of openings 28, 30; the locations of openings 28, 30 on top plate 22 and relative to each other; the size and concentricity of the braze assembly shoulder 44; and the deviation of the fitting's central axis from vertical. In addition to the stack-up tolerances in the heat exchanger 10, there are relative tolerances due to thermal expansion and manifold hole machining. As a result, the location of the base of each fitting 14, 16 may deviate by more than about 0.5 mm from the nominal centreline defined along axis A, and the top end of each fitting 14, 16 may be angled by as much as 1.5-2 degrees from vertical (i.e. relative to axis A), meaning that the position of the top end of fitting may deviate by up to about 1 mm from vertical (axis A).

During insertion of fitting 14 into socket 18 the fitting 14 should become substantially centered in socket 18 so that the O-ring 50 seals with surface 67 within compression ranges recommended by the O-ring manufacturer. At the same time, contact between the O-ring 50 and any surfaces surrounding the bottom edge or open mouth of socket 18 should be avoided. These surfaces include the bottom chamfer 74 of socket 18, and the top and bottom edges of bottom chamfer 74. Contact with the bottom edge of socket 18 could damage the O-ring 50 and/or cause it to be ejected from the groove 48, which can compromise the seal. In addition, there should be no sliding metal-to-metal contact between the fitting 14 with the sealing surface 67 of socket 18. This sealing surface 67 may be smoothly machined and could be damaged by contact with the metal portions of fitting 14, which may also compromise the fitting to socket seal.

Figure 5:
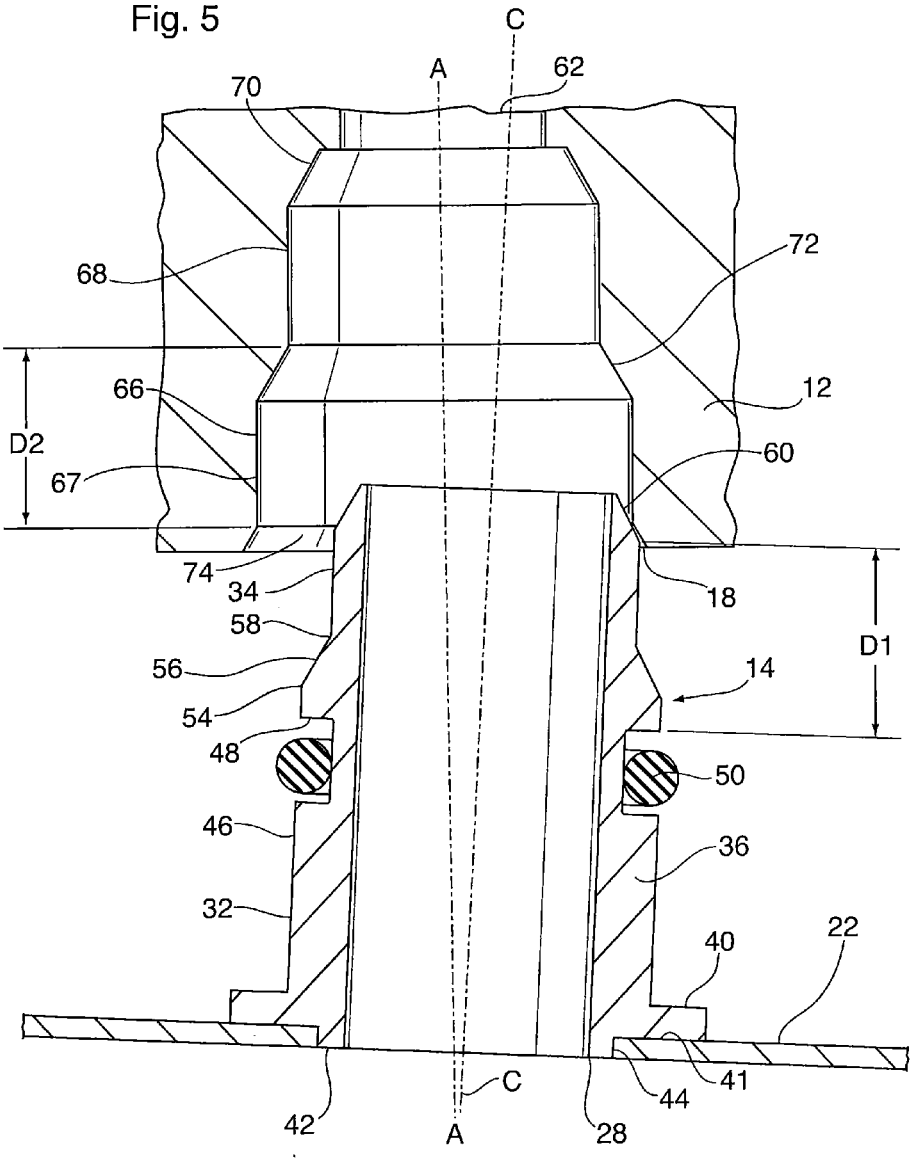
FIGS. 5, 5*a*, 6 and 7 are cross-sectional side views showing the insertion of a fitting of the heat exchanger of FIG. 1 into a socket of the rigid manifold of FIG. 1.
Figure 6:
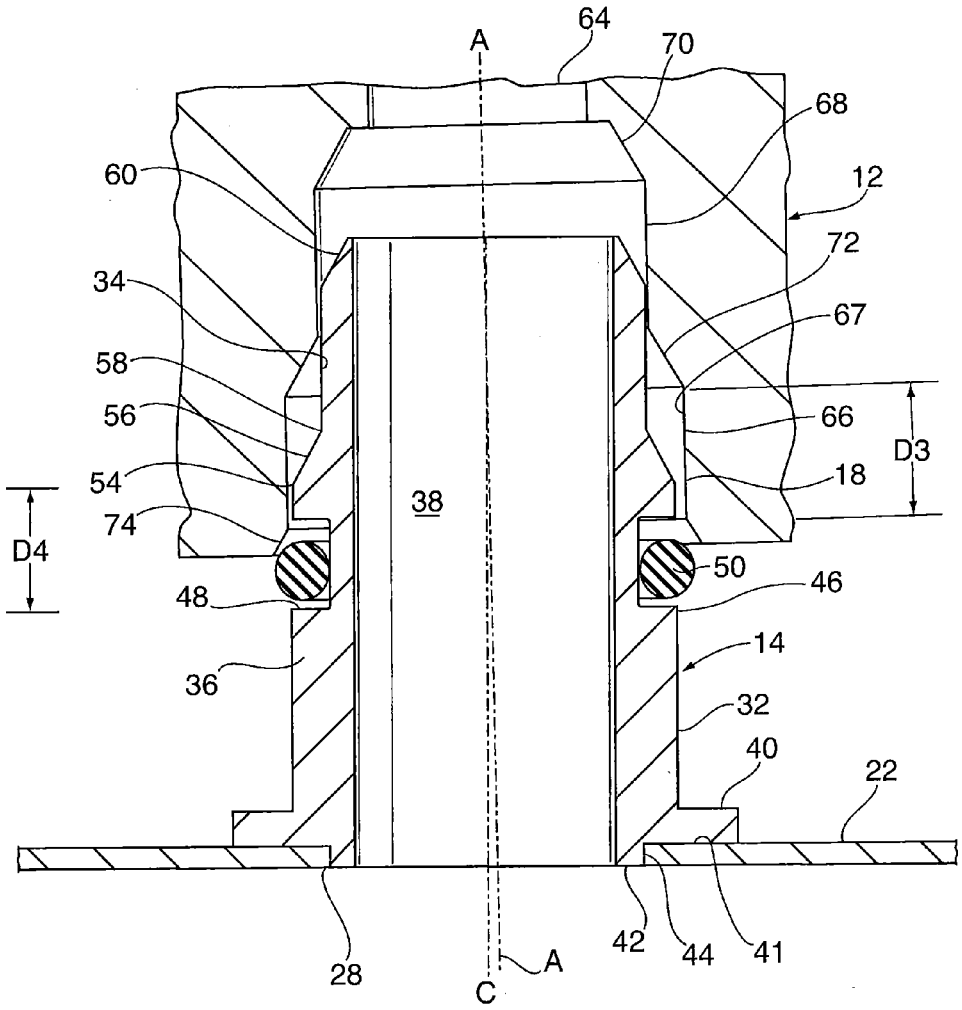
Figure 7:
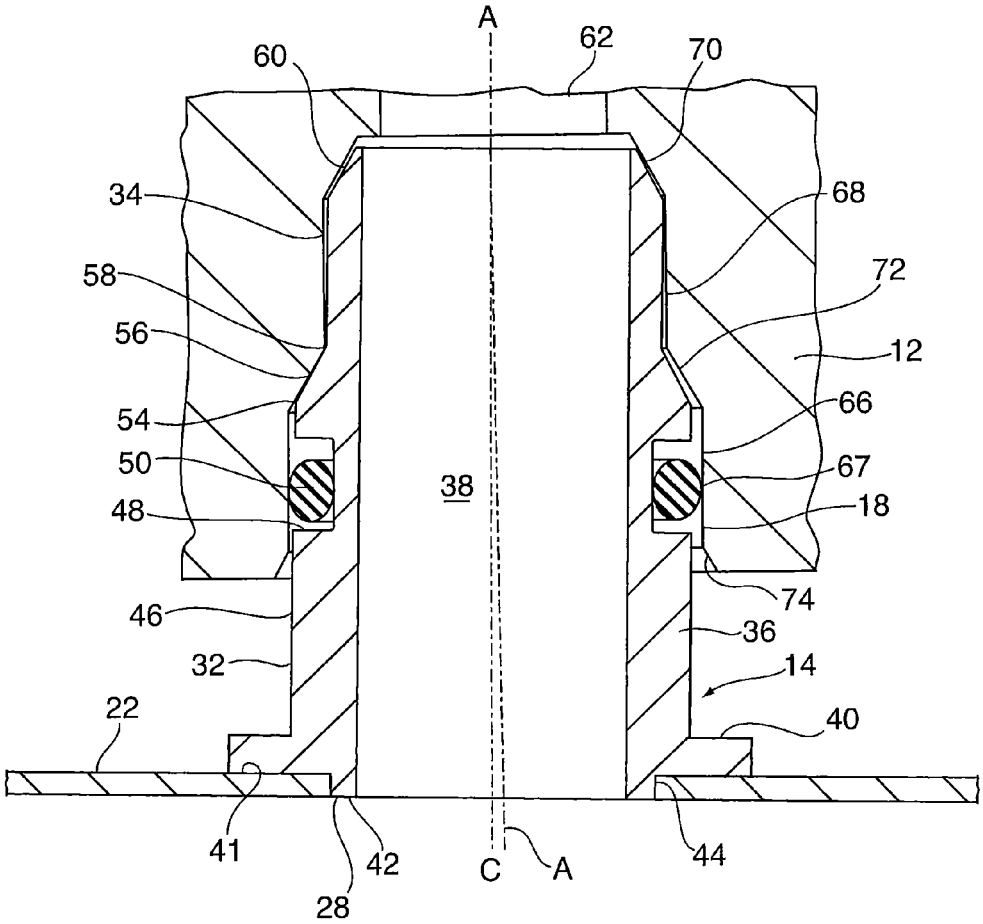

As further discussed below, the fittings 14, 16 and sockets 18, 20 are formed to permit insertion, centering and reliable sealing of the fittings 14, 16 within sockets 18, 20, while avoiding damage to the O-ring 50 and sealing surface 67. Reference is now made to FIGS. 5, 5*a*, 6 and 7, which show the insertion of fitting 14 into socket 18, with maximum socket and fitting misalignment. FIGS. 5 to 7 show misalignment between the alignment axis A and the central axis C of fitting 14, both radially and axially. For clarity and ease of illustration, this misalignment is somewhat exaggerated. Also, it will be appreciated that there may be some radial misalignment of socket 18, but this may be negligible relative to the misalignment of fitting 14 and is therefore not shown.

FIG. 5 illustrates the commencement of insertion of misaligned fitting 14 into socket 18. As shown, the first contact between fitting 14 and socket 18 may be between the top chamfer 60 of fitting 14 and the bottom chamfer 74 of socket 18. Contact between these two surfaces as the fitting 14 is inserted will cause the misaligned fitting 14 to be guided into the base portion 66 of socket 18 as it is being centered and tilted toward vertical (axis A).

To prevent metal-to-metal contact between the top portion 34 of fitting 14 and the sealing surface 67 of socket 18, the inner diameter of base portion 66 is large enough such that there will be some clearance between the top portion 34 of fitting 14 and the sealing surface 67. Therefore, the inner diameter of base portion 66, and the inner diameter of sealing surface 67, may be equal to or greater than the maximum outside diameter of the top portion 34 of fitting 14, plus the maximum diametrical position tolerance of the top end of fitting 14. This will ensure that the top portion 34 will enter the socket 18 without contacting the bottom chamfer 74 or, as shown in FIG. 5, there may be sliding contact between the top chamfer 60 of fitting 14 and the bottom chamfer 74 of socket 18 as the fitting 14 enters the socket 18. In both of these conditions, contact between the fitting 14 and the sealing surface 67 will be avoided.

Figure 5A:
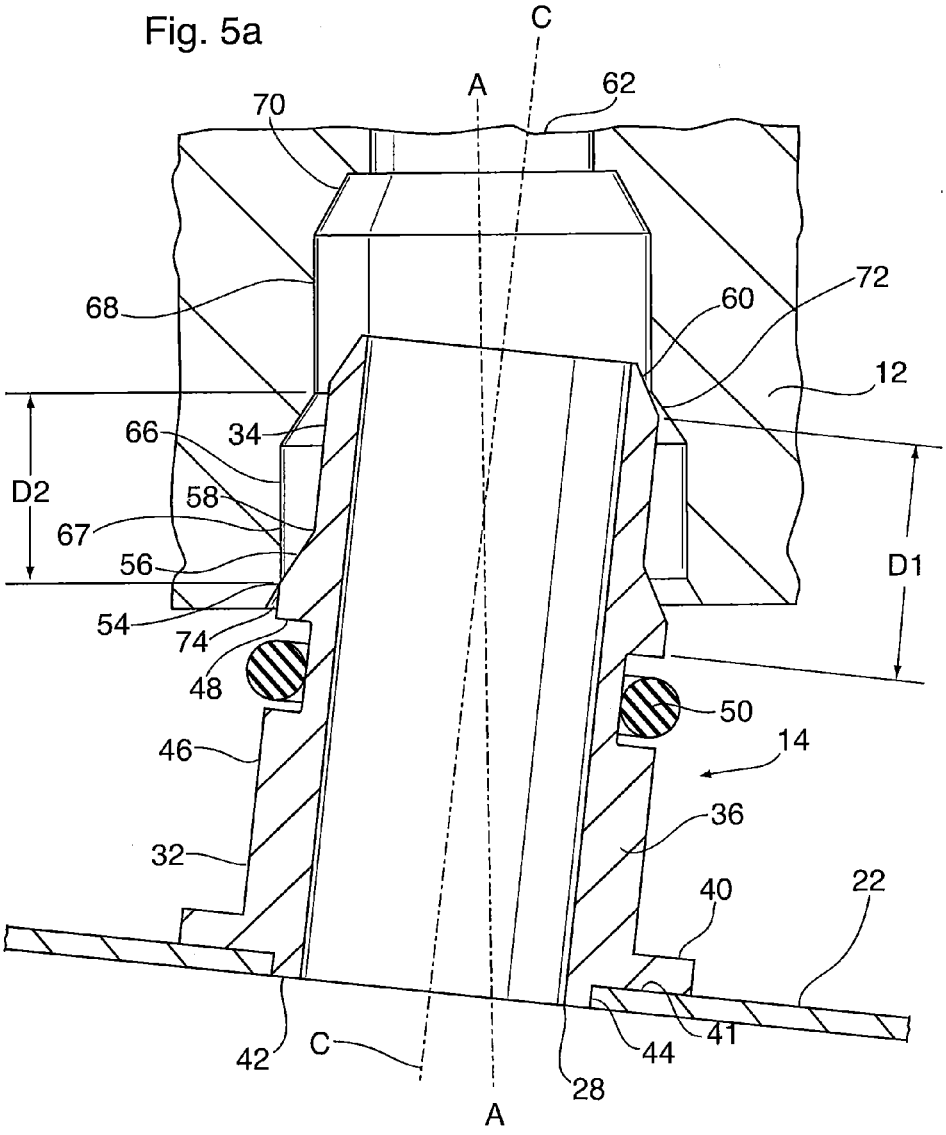

As shown in FIG. 5*a*, continued insertion of the fitting 14 into socket 18 may result in the top chamfer 60 of fitting 14 contacting the side chamfer 72 of socket 18, which separates the base portion 66 and top portion 68 of socket 18. FIG. 5*a* also shows that continued insertion of the fitting 14 into socket 18 may result in the side chamfer 56 of fitting 14 contacting the bottom chamfer 74 of socket 18. In particular, as the top end of fitting 14 begins entering the smaller diameter top portion 68 of socket 18, the sliding contact between chamfers 60 and 72 causes the top portion 34 of fitting 14 to be guided toward the top portion 68 of socket 18 as it is further being centered and tilted toward axis A.

The centering of fitting 14 continues as it is inserted, until the top chamfer 60 of fitting 14 slides upwardly past side chamfer 72 of socket 18 and the top portion 34 of fitting 14 begins to enter the top portion 68 of socket 18, as shown in FIG. 6. As also shown in FIG. 6, the larger diameter base portion 32 enters the bottom portion 66 of socket 18. At this point, the fitting 14 has been substantially centered and tilted toward axis A, and it can be seen from FIG. 6 that there is a gap between the outer surface of the base portion 34 of fitting 14 and the sealing surface 67 of socket 18. Thus, metal-to-metal contact between the sealing surface 67 and the outer surface of the base portion 32 of fitting 14 is avoided during insertion of the fitting 14.

FIG. 6 shows the partially inserted configuration where the O-ring 50 is located just outside the socket 18, in order to illustrate the manner in which the relative configurations of fitting 14 and socket 18 help to at least partially prevent damage to the O-ring. In this regard, it can be seen from FIG. 6 that contact between the O-ring 50 and the socket 18 is avoided until after the bottom edge of top chamfer 60 of fitting 14 enters the top portion 68 of socket 18. This ensures that the fitting 14 will be substantially centered and tilted toward axis A, thereby ensuring that the O-ring 50 will be substantially concentrically aligned with socket 18. Therefore, as insertion of fitting 14 into socket 18 continues, contact between the O-ring 50 and the mouth of socket 18 (i.e. the bottom edge of bottom chamfer 74) will be avoided, and this will prevent O-ring 50 from being damaged and/or dislodged from groove 48 as it passes through the mouth of socket 18.

In order to prevent damage to the O-ring 50 as discussed above, it can be seen from FIG. 5 that the distance D1 from the bottom edge of top chamfer 60 to the top of O-ring 50 and/or groove 48 is greater than a distance D2 between the top edge of side chamfer 72 and the top edge of bottom chamfer 74 and/or the mouth of socket 18. This ensures that the O-ring 50 does not enter the socket 18 until the top portion 34 of fitting 14 is guided into the top portion 68 of socket 18, and until the base portion 32 of fitting 14 is guided into the bottom portion of 66 of socket 18, as shown in FIG. 6.

As insertion of fitting 14 continues, the groove 48 and O-ring 50 enter the base portion 66 of socket 18, with the O-ring 50 undergoing even compression and sliding upwardly along sealing surface 67, without any metal-to-metal contact between the fitting 18 and the sealing surface 67 of socket 18. Insertion continues until the side chamfer 56 of fitting 14 contacts the side chamfer 72 of socket 18 and the groove 48 and O-ring 50 are completely received inside the base portion 66 of socket 18, at which point insertion is complete. The fully inserted configuration is shown in FIG. 7, from which it can be seen that the O-ring 50 is compressed between the fitting 14 and the sealing surface 67 of socket 18, and without any metal-to-metal contact between the fitting 14 and the sealing surface 67. In order to ensure proper sealing, the distance D3 from the bottom edge of side chamfer 72 to the top edge of bottom chamfer 74 of socket 18 (i.e. the height of sealing surface 67) is greater than the distance D4 from the bottom edge of side chamfer 56 to the bottom of groove 48 and/or O-ring 50 of the fitting, as shown in FIG. 6. This ensures that the O-ring 50 is located against the sealing surface 67, and is spaced above the upper edge of bottom chamfer 74.

The angles of chamfers 56, 60, 70, 72 and 74 described above are in the range of about 30-60 degrees from the vertical (axial) direction, and it will be appreciated that the angles of side chamfer 56 and top chamfer 60 of fitting 14 are about the same as the angles of side chamfer 72 and top chamfer 70 of socket 18, respectively.

A second embodiment of the invention is now described below with reference to FIGS. 8, 8*a* and 9.

The second embodiment of the invention provides a fitting 200 which may be an inlet or outlet fitting and which may form part of a heat exchanger including two such fittings 200 spaced apart from one another, and which may be otherwise similar or identical to heat exchanger 10 described above. The second embodiment also provides a socket 202 which may be an inlet or outlet socket and which may form part of a rigid manifold including two such sockets 202 spaced apart from one another, and which may be otherwise similar or identical to manifold 12 described above. As in the embodiment described above, the misalignment between fitting 200 and socket 202 is exaggerated, for clarity and ease of illustration. FIG. 8 shows the misalignment of the central longitudinal axis C of fitting 200 relative to the alignment axis A before the fitting 200 is inserted into the socket 202.

The fitting 200 and socket 202 of the second embodiment are similar in structure to the fittings 14, 16 and the sockets 18, 20 of the first embodiment described above. Therefore, like elements of fitting 200 and socket 202 are identified in the drawings using like reference numerals and, unless otherwise noted below, the descriptions of the elements of fittings 14, 16 and sockets 18, 20 apply equally to fitting 200 and socket 202.

Fitting 200 has a base portion 32 at one end and a top portion 34 at its opposite end. The base portion 32 has a larger diameter than the top portion 34. Fitting 200 also has a sidewall 36 which defines a hollow interior 38. The sidewall 36 and interior 38 are generally cylindrical, and the ends of fitting 200 are open. The base portion 32 has a planar base flange 40 at its bottom end, the base flange 40 having a flat, annular bottom sealing surface 41 which sits on top of top plate 22, as well as an annular ridge 42 and an axially extending shoulder 44.

The outer surface 46 of sidewall 36 of fitting 200 has a side chamfer 56 which forms a transition between the larger diameter base portion 32 and the smaller diameter top portion 34 of fitting 200.

The main difference between fitting 200 and fittings 14, 16 is that the sealing element of fitting 200 is provided in the top portion 34 of fitting 200, proximate to the top end of the fitting 200. Therefore, the outer surface 46 of sidewall 36 is provided with a circumferential groove 48 located in top portion 34, the groove 48 accommodating a resilient sealing member such as O-ring 50.

Socket 202 has a base portion 66 defining an open mouth, with a bottom chamfer 74 at the bottom of base portion 66. Socket 202 also has a top portion 68 with a smaller diameter than the base portion 66, through which the socket 202 is connected to manifold flow passage 62. A side chamfer 72 forms a transition between the larger diameter base portion 66 and the smaller diameter top portion 68 of socket 202. Socket 202 is substantially identical in appearance and structure to the sockets 18, 20 described above. However, due to the location of the resilient sealing member on the top portion 34 of fitting 200, the cylindrical sealing surface 67 of socket 202 is necessarily located in the top portion 68 of socket 202. The sealing surface 67 has a substantially constant diameter which is greater than the diameter of the top portion 34 of fitting 200, such that a fluid-tight seal is formed with the resilient sealing element located in the top portion 34 of fitting 200.

As in the first embodiment, the inner diameter of base portion 66 of socket 202, may be equal to or greater than the maximum outside diameter of the top portion 34 of fitting 200, plus the maximum diametrical position tolerance of the top end of fitting 200. Thus, the inner diameter of base portion 66 is large enough such that the top portion 34 of the fitting 200 will enter the base portion 66 of socket 202 such that the O-ring will not be damaged by contact with the surfaces and edges surrounding the mouth of socket 202. Depending on the degree of misalignment, the top portion 34 of fitting 200 may directly enter the top portion 68 of socket 202 or may be guided into the top portion 68 by sliding contact of the top chamfer 60 upwardly along the side chamfer 72 of socket 202, as shown in FIG. 8*a*. Also, as shown in FIG. 8*a*, the base portion 32 of fitting 200 may be guided into the bottom portion 66 of socket 202 by sliding contact of the side chamfer 56 of fitting 200 upwardly along the bottom chamfer 74 of socket 202. Thus, insertion and centering of fitting 200 in socket 202 is similar to that described above with reference to the first embodiment, except for the location of the seal.

Figure 8:
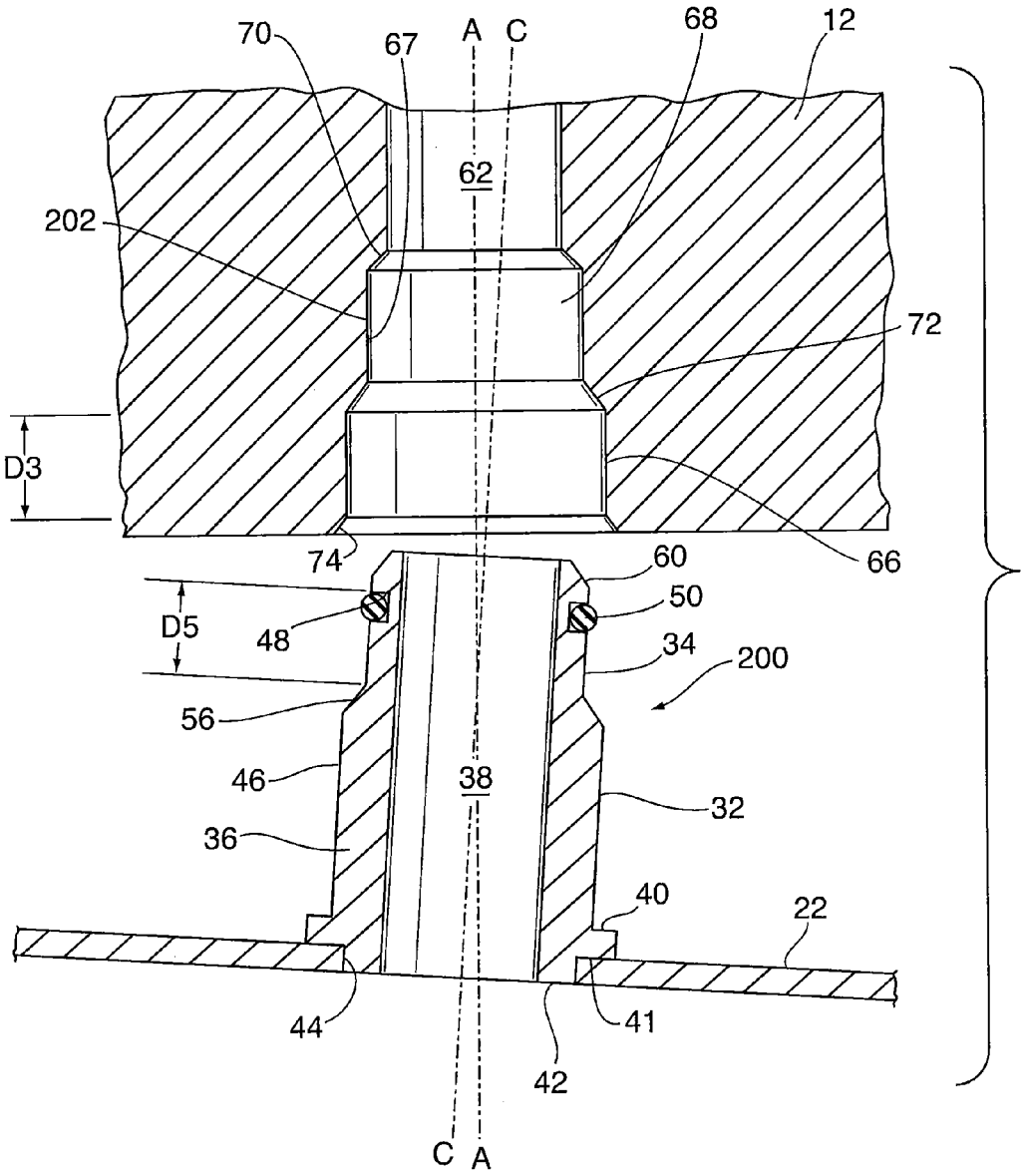
FIG. 8 is a cross-sectional side view showing a fitting of a heat exchanger and a socket of a rigid manifold according to a second embodiment of the invention, prior to insertion of the fitting into the socket.
Figure 8A:
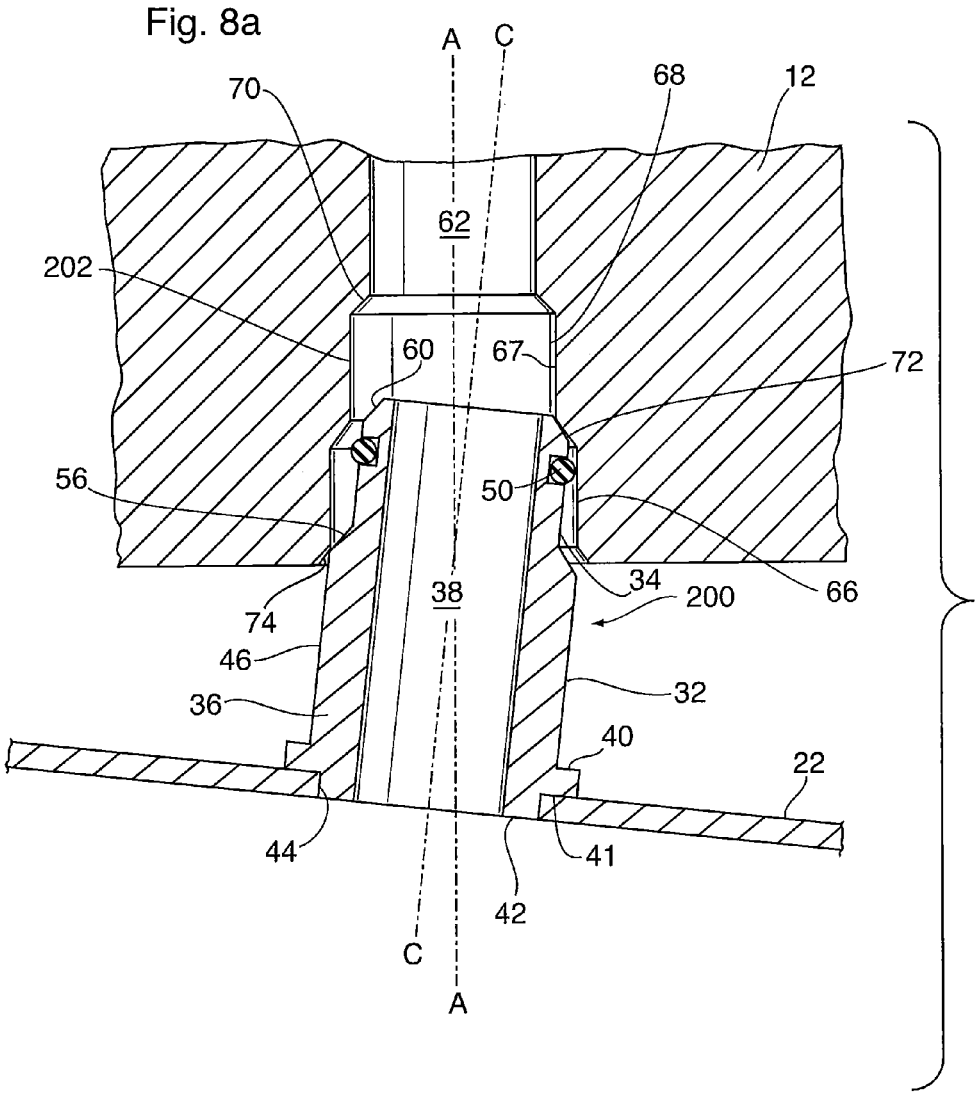
FIG. 8*a* is a cross-sectional side view showing the fitting and the socket of FIG. 8, with the fitting partly inserted into the socket.

As can be seen from FIG. 8, the socket 202 has a dimension D3 corresponding to D3 of FIG. 6, the distance from the top of bottom chamfer 74 to the bottom of side chamfer 72. In this embodiment, distance D3 is greater than D5, which is the distance from the top of the side chamfer 56 to the top of groove 48 in fitting 200. What this means is that the O-ring 50 of fitting 200 will be located at or below the side chamfer 72 of socket 202 as the base portion 32 of fitting 200 enters the bottom portion 66 of the socket 202. The entry of the base portion 32 into bottom portion 66 helps to guide the top portion 34 of fitting 200 into the top portion 68 of socket 202, while preventing damaging contact between the O-ring and the upper edge of side chamfer 72, and while preventing metal-to-metal contact between the fitting 200 and the sealing surface 67 of the socket 202.

Figure 9:
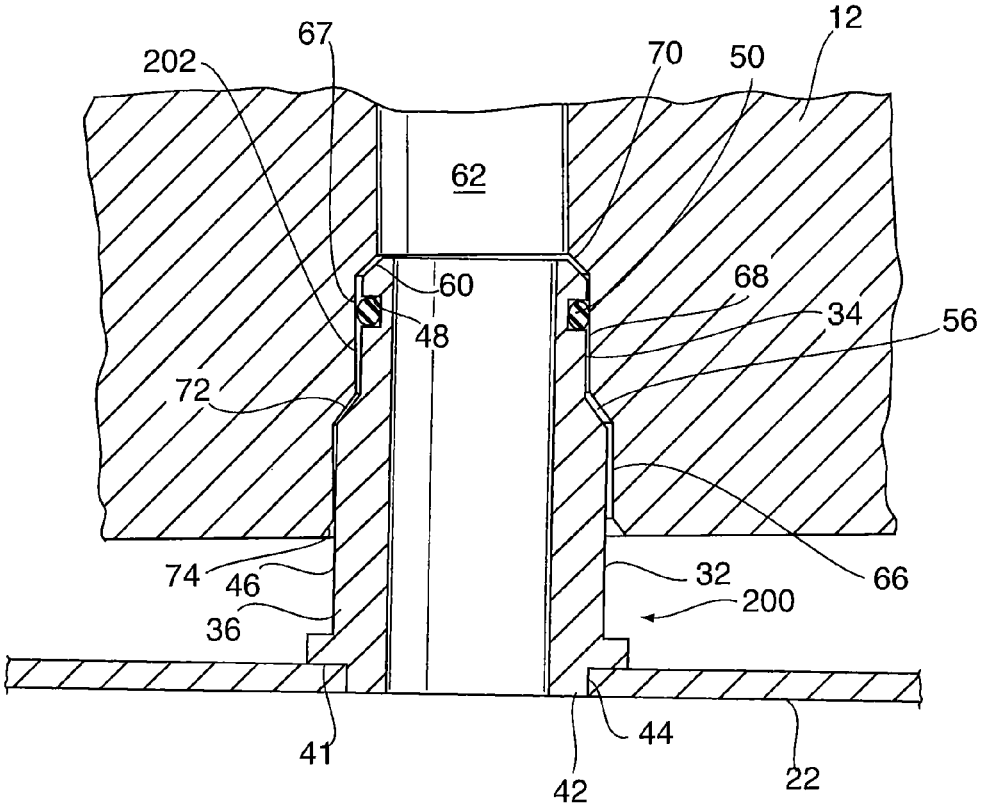
FIG. 9 is a cross-sectional side view showing the fitting and the socket of FIG. 8, with the fitting inserted into the socket.

FIG. 9 shows the fitting 200 fully inserted into and substantially aligned with the socket 202, with the O-ring 48 sealed between fitting 200 and the sealing surface 67 of socket 202.

A third embodiment of the invention is now described below with reference to FIGS. 10 to 16.

The third embodiment of the invention provides a fitting 100 which may be an inlet or outlet fitting and which may form part of a heat exchanger including two such fittings 100 spaced apart from one another, and which may be otherwise similar or identical to heat exchanger 10 described above. The drawings show only those portions of fitting 100 which are necessary for description of the third embodiment. Although not shown, it will be appreciated that the base of fitting 100 may be provided with a base flange, bottom sealing surface, ridge and shoulder similar or identical to base flange 40, bottom sealing surface 41, ridge 42 and shoulder 44 of fittings 14, 16 described above.

The third embodiment also provides a socket 102 which may be an inlet or outlet socket and which may form part of a rigid manifold including two such sockets 102 spaced apart from one another, and which may be otherwise similar or identical to manifold 12 described above. It will be appreciated that the drawings show only those portions of socket 102 which are necessary for description of the third embodiment, and the hollow interior of socket 102 will be in fluid flow communication with a manifold flow passage (not shown).

The fitting 100 has a base portion 104 through which fitting 100 is attached to the top plate of the heat exchanger, and a head 106 at the other end of fitting 100. The base portion 104 has a smaller diameter than the head 106. The fitting 100 has a sidewall 108 which defines a hollow interior 110 of fitting 100. The sidewall 108 and interior 110 are shown as being generally cylindrical and the ends of fitting 100 are open to permit fluid flow through the hollow interior 110.

The base portion 104 of fitting 100 is shown as being of substantially constant diameter. The head 106 of fitting 100 is shown as having the form of a truncated section of a sphere, being reduced in diameter at its lower edge 112 and at its upper edge 114. The lower edge 112 forms a transition point between the head 106 and base portion 104. The head 106 is of maximum diameter about midway between the lower edge and upper edge 112, 114. At this point the head 106 is provided with a circumferential groove 116 which houses a resilient sealing element in the form of an O-ring 118. The groove 116 divides the head 106 into an upper portion 107 extending from the top of groove 116 to the upper edge 114 of head 106, and a lower portion 109 extending from the bottom of groove 116 to the lower edge 112 of head 106.

The O-ring 118 is shown in FIGS. 10-14 as having a spherical outer surface and a circular cross section.

The socket 102 has an upper portion 120 of substantially constant diameter, the upper portion 120 having an inner cylindrical sealing surface 124 which is greater than the maximum diameter of the head 106 of fitting 100, such that a fluid-tight seal is formed with the head 106 of fitting 100. The socket 102 also has a lower portion 122 which is curved or chamfered radially outwardly from the bottom edge 126 of upper portion 120 toward the open mouth 128 of socket 102.

Figure 10:
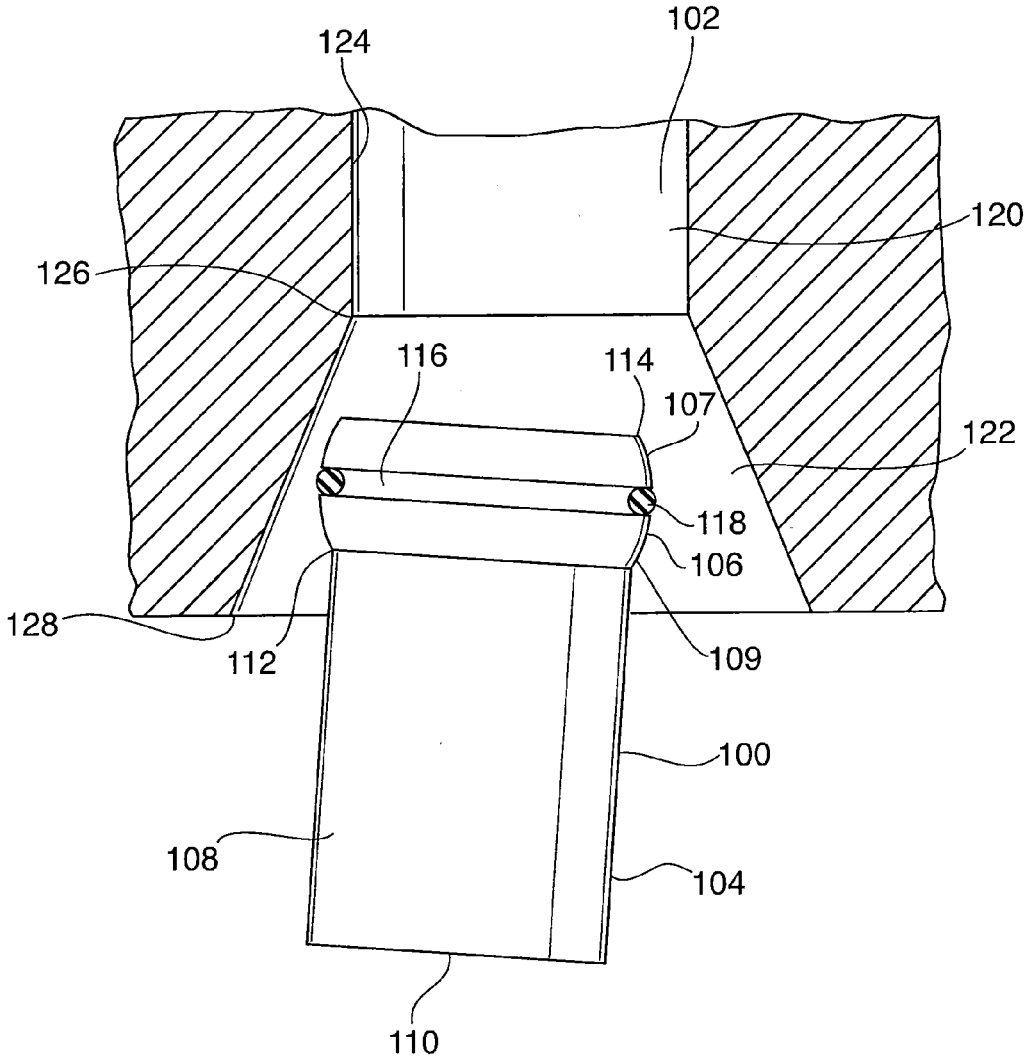
FIGS. 10-14 are cross-sectional side views showing the insertion of a fitting of a heat exchanger into the socket of a rigid manifold, according to a third embodiment of the invention.

As part of a heat exchanger assembly, the fitting 100 may be radially and/or axially misaligned in substantially the same manner as fittings 14, 16 described above. FIG. 10 shows a misaligned fitting 100 as it is being inserted into socket 102, and before any contact is made between fitting 100 and socket 102. It will be seen that the diameter of the mouth 128 of socket 102 is sufficiently large that the first contact will be between the curved side of head 106 above the O-ring 118 and the chamfer of the lower portion 122 of socket 102. Thus, the diameter of mouth 128 is greater than the diameter of head 106 at its upper edge 114, plus the maximum diametrical position tolerance of the head 106. In the illustrated embodiment, the diametrical position tolerance of the head 106 is somewhat less than the maximum tolerance.

Figure 11:
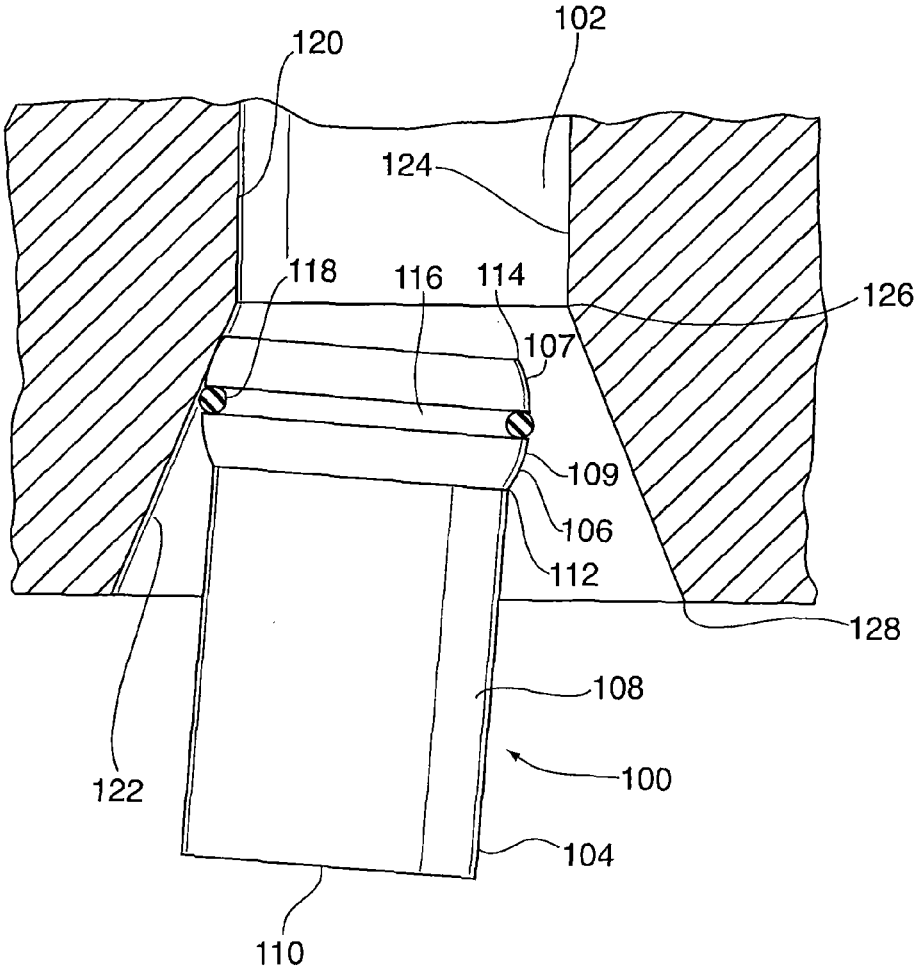

FIG. 11 shows the contact between the chamfer of lower portion 122 of socket 102 and the upper portion 107 of head 106. As the head 106 slides over the surface of lower portion 122, it can be seen that the head 106 of fitting 100 is guided inwardly and upwardly toward the sealing surface 124 as it is being centered and tilted toward vertical. As shown in FIG. 11, there is no contact between the O-ring 118 and the lower portion 122 of socket 102.

Figure 12:
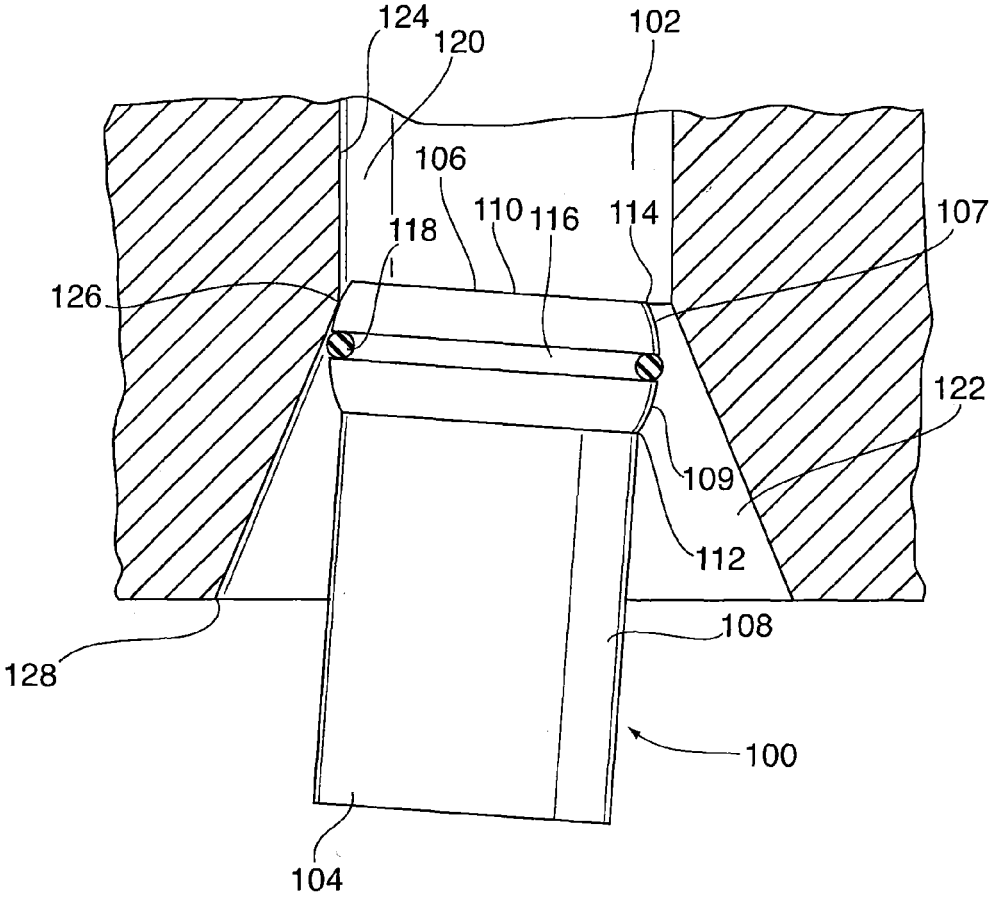

FIG. 12 shows further insertion of fitting 100, wherein the upper portion 107 of head 106 reaches the bottom edge 126 of the upper portion 120 of socket 102, and the upper edge 114 of head 106 commences its entry into the upper portion 120 of socket 102. At this point there is still no contact between the O-ring 118 and the lower portion 122 of socket 102.

Figure 13:
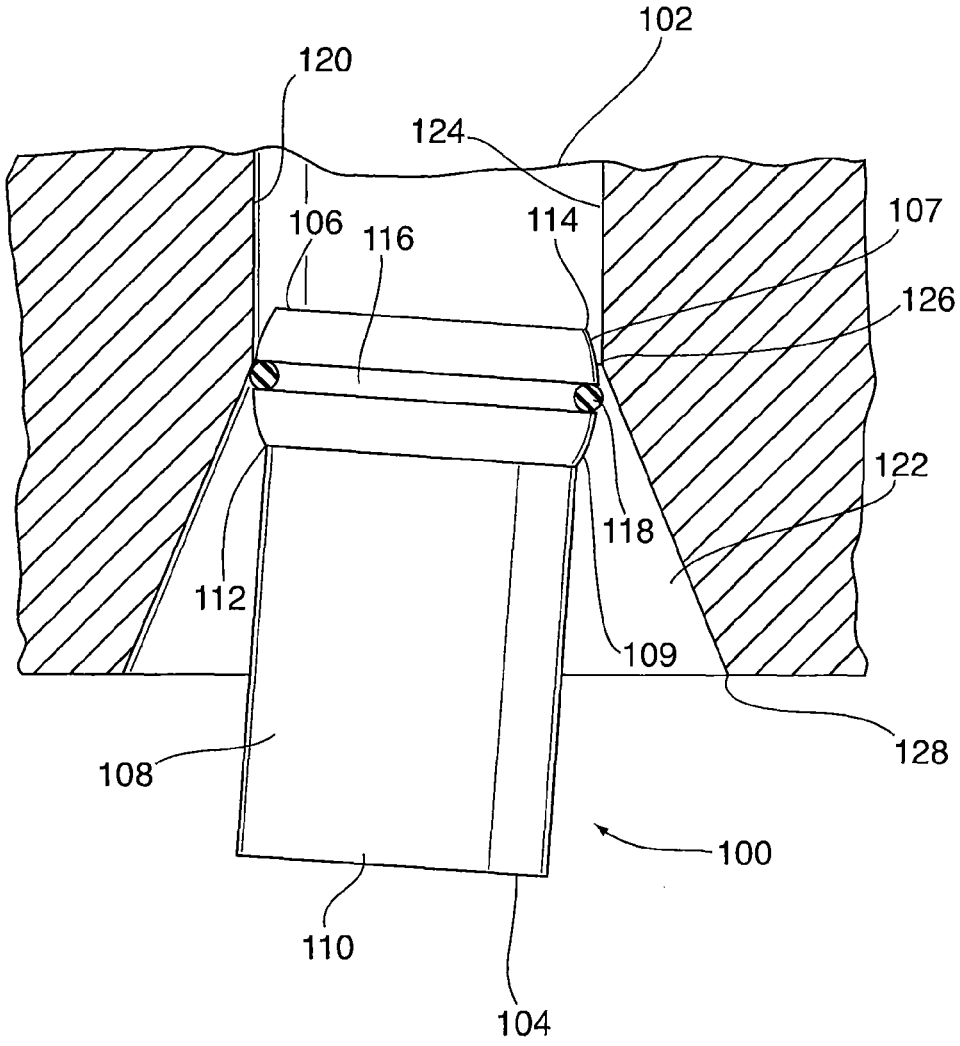
Figure 14:
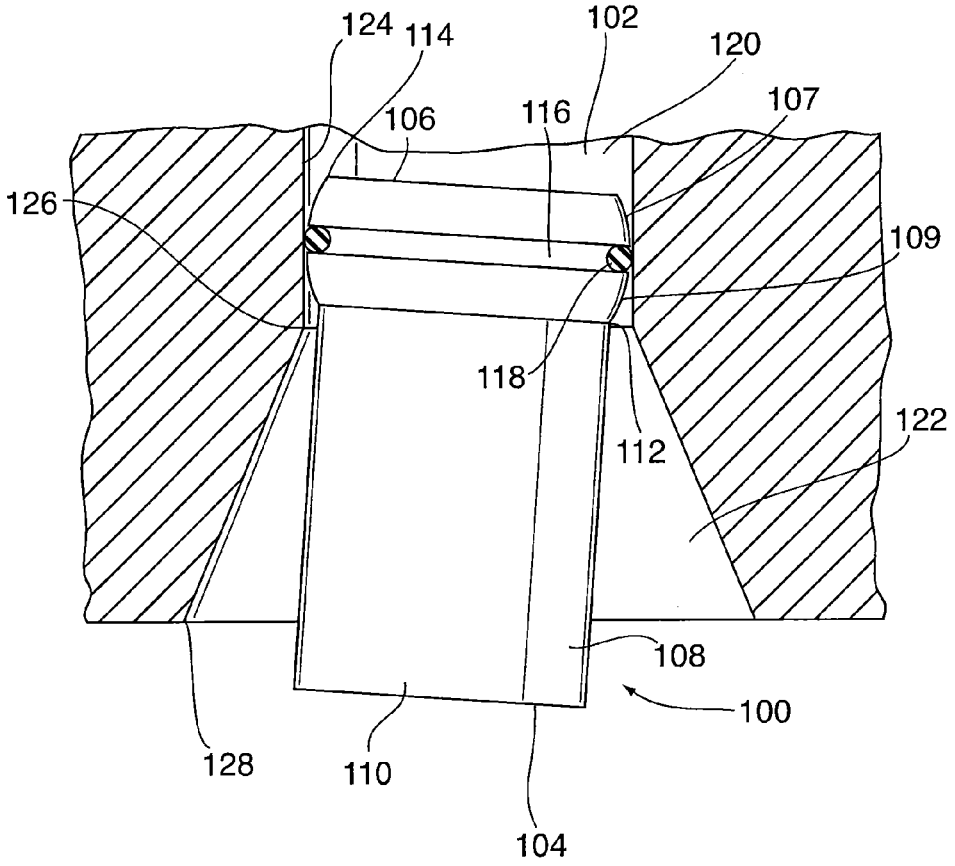

FIG. 13 shows the point at which the O-ring 118 first contacts the inner surface of socket 102, in the vicinity of the bottom edge 126 of upper portion 120. Beyond this point, the O-ring 118 slides along the sealing surface 124 as it continues to be inserted into socket 102, as shown in FIG. 14. At this point, the fitting 100 may still be axially misaligned, however, the spherical contour and the height of the O-ring 118 allow it to maintain robust sealing contact with sealing surface 124, even though it may remain misaligned relative to the vertical axis by as much as about 5 degrees.

In FIGS. 10-14 the resilient sealing element of fitting 100 comprises an O-ring 118 having cross-section which is circular in an axial plane. In order to maintain robust contact between the sealing element and the sealing surface 124 of socket 102, the O-ring of FIGS. 10-14 may be replaced by a resilient sealing element in the form of a custom shaped resilient sealing ring 130, also referred to herein as "gland 130", as shown in FIG. 15.

Figure 15:
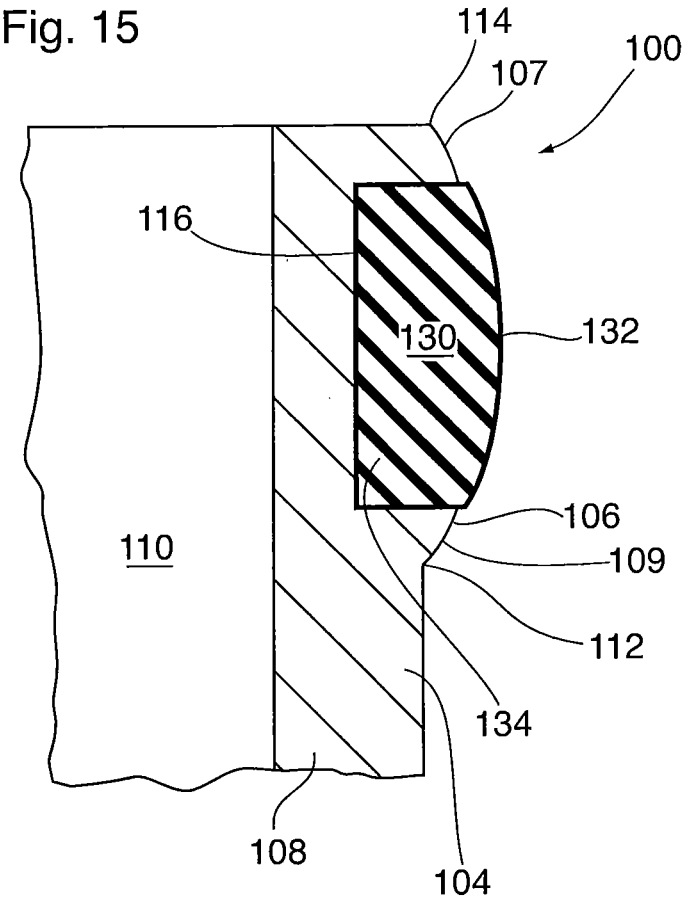
FIG. 15 is a cross-sectional side view showing a fitting according to a variant of the third embodiment of the invention.

The gland 130 has an outer sealing surface 132 which is rounded when viewed in cross-section in an axial plane as shown in FIG. 15. The rounding of sealing surface 132 allows the fitting 100 to rotate or roll over the surfaces of the socket 102 as the fitting 100 is inserted into socket 102. In the illustrated embodiment, the outer sealing surface 132 has a truncated spherical shape in axial cross-section, and has a slightly larger radius than the remainder of the head 106, so that the outer sealing surface 132 is proud of the upper portion 107 and the lower portion 109 of head 106.

In the fitting 100 shown in FIG. 15, the groove 116 in head 106 has a rectangular cross-sectional shape in an axial plane, and the inner portion 134 of gland 130 similarly has a rectangular profile so that it fits snugly into groove 116.

It can be seen that the gland 130 has a height (the axial distance between the top and bottom of groove 116 or inner portion 134) which may be greater than that of O-ring 118. This provides the head 106 with a greater sealing surface 132 to ensure robust contact with the sealing surface 124 of socket 102, and allows a seal to be maintained in the event that there is significant tilting of the fitting 100 relative to the vertical (axial) direction. For example, the height of gland 130 may be greater than 50% of the height of the head 106, measured axially between the lower edge 112 and upper edge 114 of head 106.

Figure 16:
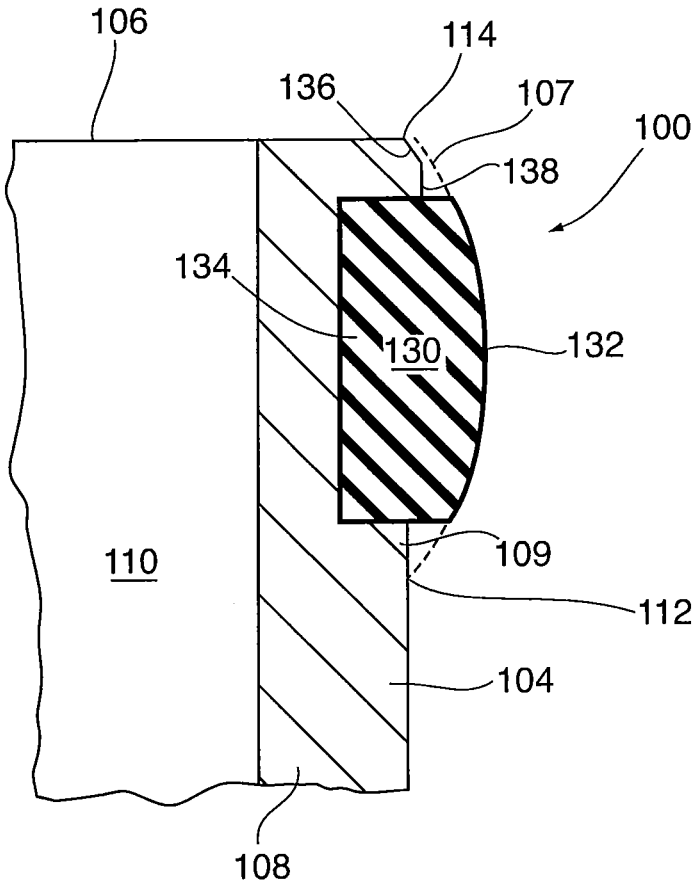
FIG. 16 is a cross-sectional side view showing a fitting according to another variant of the third embodiment.

It will be appreciated that the head 106 of fitting 100 may be modified without departing from the invention, particularly where the resilient sealing element comprises gland 130. For example, as shown in FIG. 16, the spherical profile of the lower portion 109 of head 106 may be eliminated because this portion of head 106 does not make contact with the interior surfaces of 102 during insertion of the fitting 100. For example, as shown in FIG. 16, the lower portion 109 of head 106 may be provided with a vertical, cylindrical surface and may have the same diameter as the outer surface of base portion 104, such that the lower portion 109 of 106 appears as a continuation of the base portion 104. Alternatively, the lower portion 109 of head 106 may be chamfered instead of rounded, so long as the chamfer does not extend outwardly past the outer sealing surface 132 of gland 130.

Similarly, the upper portion 107 of head 106 does not necessarily have a continuously rounded profile as shown in FIGS. 10-15, but may instead include a chamfer 136 extending downwardly and outwardly from the upper edge 114, for example as shown in FIG. 16. The upper portion 107 of head 106 may also include a vertical portion 138 as shown in FIG. 16, extending from the base of chamfer 136 to the top of groove 116. However, it will be appreciated that this vertical portion 138 may be eliminated if the chamfer 136 extends throughout the entire height of upper portion 107, or if the area between the chamfer 136 and groove 116 maintains its rounded shape as in FIGS. 10-15. Regardless of its shape, however, no portion of upper portion 107 extends outwardly past the outer sealing surface 132 of gland 130.

Although the invention has been described in connection with certain embodiments, it is not restricted thereto. Rather, the invention includes all embodiments which may fall within the scope of the following claims.

What is claimed is:

1. A heat exchanger, comprising:

an inlet opening provided with an inlet fitting;

an outlet opening provided with an outlet fitting, wherein the inlet and outlet fittings are hollow and have open ends, and wherein the fittings face in the same direction and are spaced apart from one another;

wherein each of the fittings have a cylindrical base portion and a cylindrical top portion, wherein each of the fittings is provided with a circumferential groove extending about its entire circumference, and a resilient sealing element is received in the groove;

wherein the base portion of each of the fittings has a flat, annular sealing surface which is sealed to a surface of the heat exchanger in an area surrounding the inlet opening or the outlet opening;

wherein the circumferential groove and the resilient sealing element are provided in the base portion, and wherein each of the fittings further comprises a sloped surface which forms a transition between the base portion and the top portion of the fitting, such that the base portion extends to a bottom edge of the sloped surface.

2. The heat exchanger according to claim 1, wherein the base portion of each of the fittings has a radially outwardly extending planar base flange, and wherein the flat, annular sealing surface comprises a bottom surface of the planar base flange, and wherein said surface of the heat exchanger is flat.

3. The heat exchanger according to claim 1, wherein said surface of the heat exchanger comprises an outer surface of a plate comprised of an aluminum brazing sheet, wherein the inlet and outlet fittings are formed of aluminum or an aluminum alloy, and wherein the inlet and outlet fittings are both sealed to the outer surface of said plate by brazing.

4. The heat exchanger according to claim 1, wherein the cylindrical base portion has a larger diameter than the cylindrical top portion.

5. The heat exchanger according to claim 1, wherein the circumferential groove of the base portion of each said fitting is located approximately midway between the open ends.

6. The heat exchanger according to claim 1, wherein each of the fittings has a top end with a radially inwardly extending sloped surface.

7. A heat exchanger, comprising:

an inlet opening provided with an inlet fitting;

an outlet opening provided with an outlet fitting, wherein the inlet and outlet fittings are hollow and have open ends, and wherein the fittings face in the same direction and are spaced apart from one another;

wherein each of the fittings have a cylindrical base portion and a top portion, wherein each of the fittings is provided with a circumferential groove extending about its entire circumference, and a resilient sealing element is received in the groove;

wherein the base portion of each of the fittings has a flat, annular sealing surface which is sealed to a surface of the heat exchanger in an area surrounding the inlet opening or the outlet opening;

wherein the top portion has a larger diameter than the cylindrical base portion, and wherein the circumferential groove and the resilient sealing element are provided in the top portion;

wherein the groove has a rectangular cross-section and the sealing member comprises a sealing gland having a rectangular profile on its inner radial face, and having a spherical profile on its outer radial face; and wherein the top portion of the fitting has a truncated spherical cross-section having a radius which is less than a radius of the spherical profile on the outer radial face of the sealing gland.

8. The heat exchanger according to claim 7 in combination with a rigid manifold, wherein the rigid manifold comprises an inlet socket in which the inlet fitting is received, and an outlet socket in which the outlet fitting is received;

each of the sockets having a base portion proximate to an open mouth of the socket, and a cylindrical top portion distal therefrom, wherein the top portion of the socket receives the top portion of one of the fittings, and the base portion of the socket receives the base portion of the same fitting, and wherein an inner cylindrical surface of the base portion of the socket provides a sealing surface against which the resilient sealing member is received with a fluid-tight seal.

9. In combination, a heat exchanger and a rigid manifold, wherein the heat exchanger has an inlet opening provided with an inlet fitting and an outlet opening provided with an outlet fitting, wherein the inlet and outlet fittings face in the same direction and are spaced apart from one another;

wherein the rigid manifold comprises an inlet socket in which the inlet fitting is received, and an outlet socket in which the outlet fitting is received, the inlet and outlet sockets being spaced apart from one another;

each of the fittings having a cylindrical base portion proximate to the inlet or outlet opening with which it is associated, and a cylindrical top portion distal therefrom, the base portion having a larger diameter than the top portion, wherein the base portion or the top portion is provided with a circumferential groove extending about its entire circumference, and a resilient sealing element is received in the groove;

each of the sockets having a cylindrical base portion proximate to an open mouth of the socket, and a cylindrical top portion distal therefrom, wherein the top portion of the socket receives the top portion of one of the fittings, and the base portion of the socket receives the base portion of the same fitting, and wherein an inner cylindrical surface of the socket provides a sealing surface against which the resilient sealing member is received with a fluid-tight seal; and wherein the sealing surface of each of the sockets has an inner diameter which is equal to or greater than a maximum outside diameter of the top or bottom portion of the fitting with which it is associated, plus a maximum diametrical position tolerance of a top end of the fitting.

10. The combination according to claim 9, wherein each of the fittings further comprises a sloped surface which forms a transition between the base portion and the top portion of the fitting;

wherein each of the sockets further comprises a sloped surface which forms a transition between the base portion and the top portion of the socket; and wherein the sloped surface of each fitting engages the sloped surface of the socket with which it is associated with the fitting completely inserted in the socket.

11. The combination according to claim 9, wherein each of the fittings has a top end distal from the base, and wherein a distance from the top end of the fitting to the resilient member is greater than a distance from the open mouth of the socket to the bottom end of the top portion of the socket.

12. The combination according to claim 9, wherein each of the fittings has a top end with a radially inwardly extending sloped surface, and wherein a distance between a bottom end of the sloped surface and the resilient member is greater than a distance from the open mouth of the socket to the bottom end of the top portion of the socket.

13. The combination according to claim 9, wherein the cylindrical base portion of each said fitting is provided with said circumferential groove and said resilient sealing element; and wherein the inner cylindrical surface of each said socket which provides said sealing surface is located in the cylindrical base portion thereof.

14. The combination according to claim 9, wherein the cylindrical top portion of each said fitting is provided with said circumferential groove and said resilient sealing element; and wherein the inner cylindrical surface of each said socket which provides said sealing surface is located in the cylindrical top portion thereof.

* * * * *